United States Patent [19]

Phillips et al.

[11] Patent Number: 4,898,127

[45] Date of Patent: Feb. 6, 1990

[54] TWO-STROKE CYCLE ENGINE WITH VACUUM PULSE BALANCING SYSTEM

[75] Inventors: George E. Phillips, Oshkosh; John M. Griffiths, Fond du Lac, both of Wis.

[73] Assignee: Brunswick Corporation, Skokie, Ill.

[21] Appl. No.: 326,120

[22] Filed: Mar. 20, 1989

[51] Int. Cl.[4] ..... F02B 33/04

[52] U.S. Cl. ..... 123/73 A; 123/52 MB

[58] Field of Search ..... 123/73 A, 73 D, 73 V, 123/73 R, 65 R, 52 MB, 52 M

[56] References Cited

U.S. PATENT DOCUMENTS

| | | | |
|---|---|---|---|
| 1,307,896 | 6/1919 | Colardeau . | |
| 2,126,649 | 8/1938 | Lytle et al. | 123/52 MB |
| 2,630,791 | 3/1953 | Kiekhaefer | 123/73 V |
| 2,794,431 | 6/1957 | Ginnow | 123/73 A |
| 3,289,656 | 12/1966 | Strang | 123/52 M |
| 3,505,983 | 4/1970 | Hartel | 123/52 M |
| 3,929,111 | 12/1975 | Turner et al. | 123/73 A |
| 4,071,000 | 1/1978 | Herbert | 123/73 V |
| 4,368,698 | 1/1983 | Matsuo et al. | 123/52 M |
| 4,457,267 | 7/1984 | Gorr | 123/73 R |
| 4,481,910 | 11/1984 | Sheaffer | 123/73 R |
| 4,481,911 | 11/1984 | Sheaffer et al. | 123/73 R |
| 4,509,472 | 4/1985 | Slattery | 123/73 A |
| 4,519,363 | 5/1985 | Bernardoni et al. | 123/432 |
| 4,527,392 | 7/1985 | Sato et al. | 123/52 MB |
| 4,549,506 | 10/1985 | Rush II et al. | 123/52 MB |
| 4,825,821 | 5/1989 | Baltz et al. | 123/73 A |

*Primary Examiner*—David A. Okonsky

*Attorney, Agent, or Firm*—Robert C. Curfiss

[57] ABSTRACT

A pulse balancing system is provided for a multicylinder two-stroke cycle internal combustion engine in which each cylinder is provided with its own mechanism for supplying an air-fuel mixture thereto. The vacuum pulse balancing system of the invention comprises a plurality of passages interconnecting each cylinder with one of the air-fuel mixture supply devices associated with one of the other cylinders, and one-way check valves provided in the passages. With the vacuum pulse balancing system of the invention, a vacuum pulse created by the piston in one of the cylinders is transferred not only to the air-fuel mixture supply device associated therewith, but also to the air-fuel mixture supply device associated with one of the other cylinders. This alleviates back pressure which may otherwise be caused in the air-fuel mixture supply device associated with the other cylinder due to the on-again off-again suction of air-fuel mixture therefrom to its associated cylinder.

9 Claims, 2 Drawing Sheets

TWO-STROKE CYCLE ENGINE WITH VACUUM PULSE BALANCING SYSTEM

BACKGROUND AND SUMMARY

This invention relates to an internal combustion engine, and more particularly to a multicylinder two-stroke cycle engine in which a separate carburetor or other air-fuel supply means is provided for each cylinder.

In a multicylinder two-stroke cycle engine, which is typically employed in the power head of an outboard marine motor, it is known to provide one carburetor for each cylinder for maximum power output. With such an arrangement, air-fuel mixture is drawn into the cylinder crankcase compartment from the carburetor during the upward compression stroke of the piston. The air-fuel mixture typically passes through a manifold disposed between the carburetor and the crankcase. A reed valve or other such one-way valve is installed at the inlet to the cylinder crankcase compartment to provide one-way flow of air-fuel mixture thereinto. During the power stroke of the piston, the reed valve closes to prevent back flow of air-fuel mixture into the manifold. This cycle constantly repeats, resulting in intermittent drawing of air-fuel mixture from the carburetor.

As a result of the above-described operation, the carburetor associated with each cylinder is subjected to an on-again off-again suction resulting from the vacuum pulse of the piston during its compression stroke. This is in direct contrast to the situation in which a multicylinder engine is provided with a single carburetor. With such an arrangement, the carburetor is constantly subjected to a vacuum pulse from one cylinder or another, resulting in a substantially constant supply of air-fuel mixture therefrom.

It has been found that, in a two-stroke cycle engine in which a single carburetor provides air-fuel mixture to a single cylinder, the on-again off-again suction of air-fuel mixture from the carburetor provides certain undesirable operating characteristics. Illustratively, when the reed valve is closed and flow into the cylinder prevented, the air-fuel mixture can "bounce" off the closed reed valve due to its inertial mass. This results in back flow of the air-fuel mixture through the carburetor and spit back of the air-fuel mixture through the carburetor inlet. The inertia of the back flowing air-fuel mixture must then be overcome by the vacuum pulse created by the piston in its upward stroke in order to draw the air-fuel mixture through the reed valve and into the cylinder crankcase compartment. This results in a decrease in engine performance.

One solution to this problem has been to provide an unrestricted path of communication between the intake lines or manifolds downstream of the separate carburetors. This arrangement allows the vacuum pulse from one cylinder to suck air-fuel mixture not only from the carburetor to which it is directly connected, but also from the line interconnecting the remaining carburetors in the system. The air-fuel mixture in this line reciprocates back and forth depending on the source of the vacuum pulse at a particular point in time. Accordingly, each carburetor is subjected not only to the vacuum pulse from its associated cylinder, but also to a small degree to the vacuum pulses from the other cylinders.

It is an object of the present invention to provide a more satisfactory solution to the above-described problems than that provided by the prior art. More particularly, it is an object of the invention to specifically direct the vacuum pulse from one cylinder in a multicylinder system not only to its primary carburetor, but also to another carburetor in the system to relieve back pressure in the intake line connected to such secondary carburetor. This system reduces back flow through the secondary carburetor by subjecting it to a specifically directed vacuum pulse at a time when the secondary cylinder would not otherwise be subjected to a vacuum pulse from its cylinder.

In accordance with the invention, vacuum pulse balancing means is provided for a multicylinder two-stroke cycle engine in which each cylinder is provided with a separate air-fuel mixture supply means and intake means for supplying air-fuel mixture from the air-fuel supply means to its associated cylinder. The vacuum pulse balancing means comprises a plurality of passages disposed downstream of each air-fuel mixture supply means. The passages place each air-fuel mixture supply means in communication with a cylinder other than the cylinder with which the air-fuel mixture supply means is primarily associated. One-way valve means is provided within each passage for transferring a vacuum pulse from one intake line to another in a proper sequence, thereby increasing the amount of time to which the secondary carburetor is subject to a vacuum pulse. Back flow of air-fuel mixture in the intake line associated with the secondary carburetor is thereby relieved.

BRIEF DESCRIPTION OF THE DRAWINGS

The drawings illustrate the best mode presently contemplated of carrying out the invention.

In the drawings.

DETAILED DESCRIPTION OF THE PREFERRED EMBODIMENT

Figure 1:
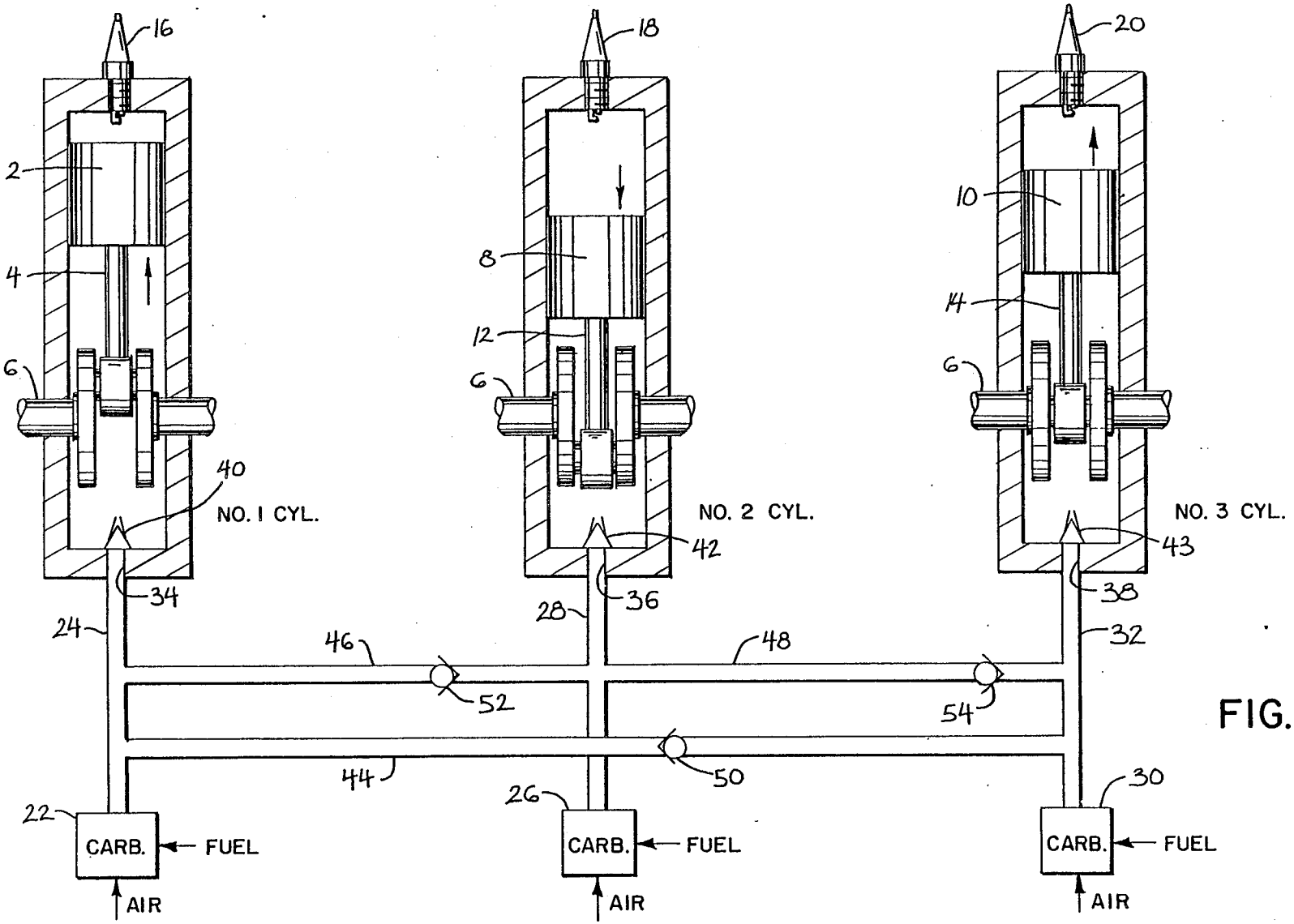
FIG. 1 illustrates the vacuum pulse interconnecting system of the invention as applied to a three cylinder two-stroke cycle internal combustion engine.

FIG. 1 illustrates schematically a three cylinder two-stroke cycle internal combustion engine. A piston 2 is slidably mounted for reciprocating movement within the interior of the number 1 cylinder, as is known, and is connected via a piston rod 4 to a crankshaft 6 in a conventional manner. In a like manner, the number 2 and 3 cylinders are provided with pistons 8 and 10, respectively, which are mounted via piston rods 12, 14 to crankshaft 6.

As is known, the area above each piston in its respective cylinder makes up a combustion chamber, while the area below the piston makes up a crankcase compartment.

Spark plugs are mounted to the upper ends of each cylinder adjacent the combustion chamber to ignite compressed air-fuel mixture disposed therein, as is known. As shown, spark plugs 16, 18 and 20 are mounted to the numbers 1, 2 and 3 cylinders, respectively.

In a high horsepower engine, such as that with which the present invention is concerned, each cylinder is provided with a separate carburetor for supplying air-fuel mixture thereto. As shown, a carburetor 22 is interconnected with the number 1 cylinder through an intake line or manifold 24; a carburetor 26 is interconnected with the number 2 cylinder through an intake line or manifold 28; and a carburetor 30 is interconnected with the number 3 cylinder through an intake line or manifold 32. Manifolds 24, 28 and 32 are interconnected with their respective cylinders through intake ports 34, 36 and 38, respectively. A one-way reed valve is mounted in the crankcase compartment of each cylinder adjacent its inlet port. As shown, a reed valve 40 is mounted within the crankcase compartment of the number 1 cylinder adjacent its inlet port 34; a reed valve 42 is mounted within the crankcase compartment of the number 2 cylinder adjacent its inlet port 36; and a reed valve 43 is mounted within the crankcase compartment of the number 3 cylinder adjacent its inlet port 38.

According to known operation of a two-stroke cycle engine, air-fuel mixture is sucked into the crankcase compartment of each cylinder through its respective manifold and reed valve during the upward compression stroke of the piston associated with the cylinder. When the piston then begins its downward power stroke after ignition, the reed valve is closed so as to prevent back flow of air-fuel mixture out of the crankcase compartment. The air-fuel mixture in the crankcase compartment is then transferred into the combustion chamber through known principles, whereafter such mixture is compressed during the upward stroke of the piston and thereafter fired by ignition of the spark plug to provide the power stroke.

With the construction shown, wherein each cylinder is provided with a separate carburetor, the carburetor is subjected to a constant on-again off-again flow of air-fuel mixture therefrom into the intake manifold, and thereby into the cylinder crankcase compartment. As described previously, such operation can result in back flow of air-fuel mixture into the carburetor due to "bouncing" of the inertial mass of the air-fuel mixture off the closed reed valve and reverse flow through the carburetor. To alleviate this problem, passages are provided for transferring the vacuum pulse from one cylinder to the intake manifold associated with one of the other cylinders. In this manner, the intake manifold associated with the other cylinder is subjected to a vacuum pulse at a time when it would not otherwise be subjected to a vacuum pulse from the cylinder to which it is directly connected. As shown in FIG. 1, a passage 44 extends between and interconnects intake manifold 24 and intake manifold 32. A passage 46 extends between and interconnects intake manifold 28 and intake manifold 24, and a passage 48 extends between and interconnects intake manifold 32 and intake manifold 28.

Check valves 50, 52 and 54 are provided in passages 44, 46 and 48, respectively for ensuring one-way transfer of vacuum pulses through the passages.

In a three cylinder two-stroke cycle engine such as that shown, the firing order typically employed is 1-3-2. According to the invention, the vacuum pulses from the respective cylinders are transferred in a like sequence. When the number 1 cylinder is in its upward stroke so as to create a vacuum pulse in intake manifold 24 to draw air-fuel mixture from carburetor 22, such vacuum pulse is simultaneously transferred through passage 46 and check valve 52 to carburetor 26, associated with the number 2 cylinder. At this time, the piston within the number 2 cylinder is in its power stroke so that reed valve 42 is closed and carburetor 26 would not be subjected to a vacuum pulse from the number 2 cylinder. Check valve 52 in passage 46 prevents communication of the vacuum pulse to carburetor 26. In a like manner, when the piston within the number 3 cylinder is in its compression stroke so as to open reed valve 43 and suck air-fuel mixture from carburetor 30 through intake manifold 32, such vacuum pulse is transferred via check valve 50 and passage 44 to carburetor 22 associated with the number 1 cylinder. At this time, the piston within the number 1 cylinder is in its power stroke so that reed valve 40 is closed and carburetor 22 would otherwise not be subjected to a vacuum pulse. Check valve 54 in passage 48 prevents transfer of the vacuum pulse from the number 3 cylinder to carburetor 26 associated with the number 2 cylinder. Finally, when piston 8 within the number 2 cylinder is in its compression stroke so as to provide a vacuum pulse to carburetor 26 through intake manifold 28, such pulse is transferred through passage 48 and check valve 54 to draw air-fuel mixture therefrom and to subject carburetor 30 to the vacuum pulse. At this time, the number 3 cylinder, to which carburetor 30 is directly connected, is in its power stroke so that intake of air-fuel mixture through manifold 32 would otherwise be cut off by reed valve 43. Check valve 52 in passage 46 prevents transfer of the vacuum pulse to carburetor 22 associated with the number 1 cylinder.

With the system of interconnecting passages and check valves as described, the individual carburetors associated with each cylinder are subjected to vacuum pulses over a wider range of time than otherwise possible. This prevents back flow of air-fuel mixture through the intake manifold associated with each carburetor which otherwise may occur when flow of air-fuel mixture through the intake manifold is prevented by the reed valve.

Figure 2:
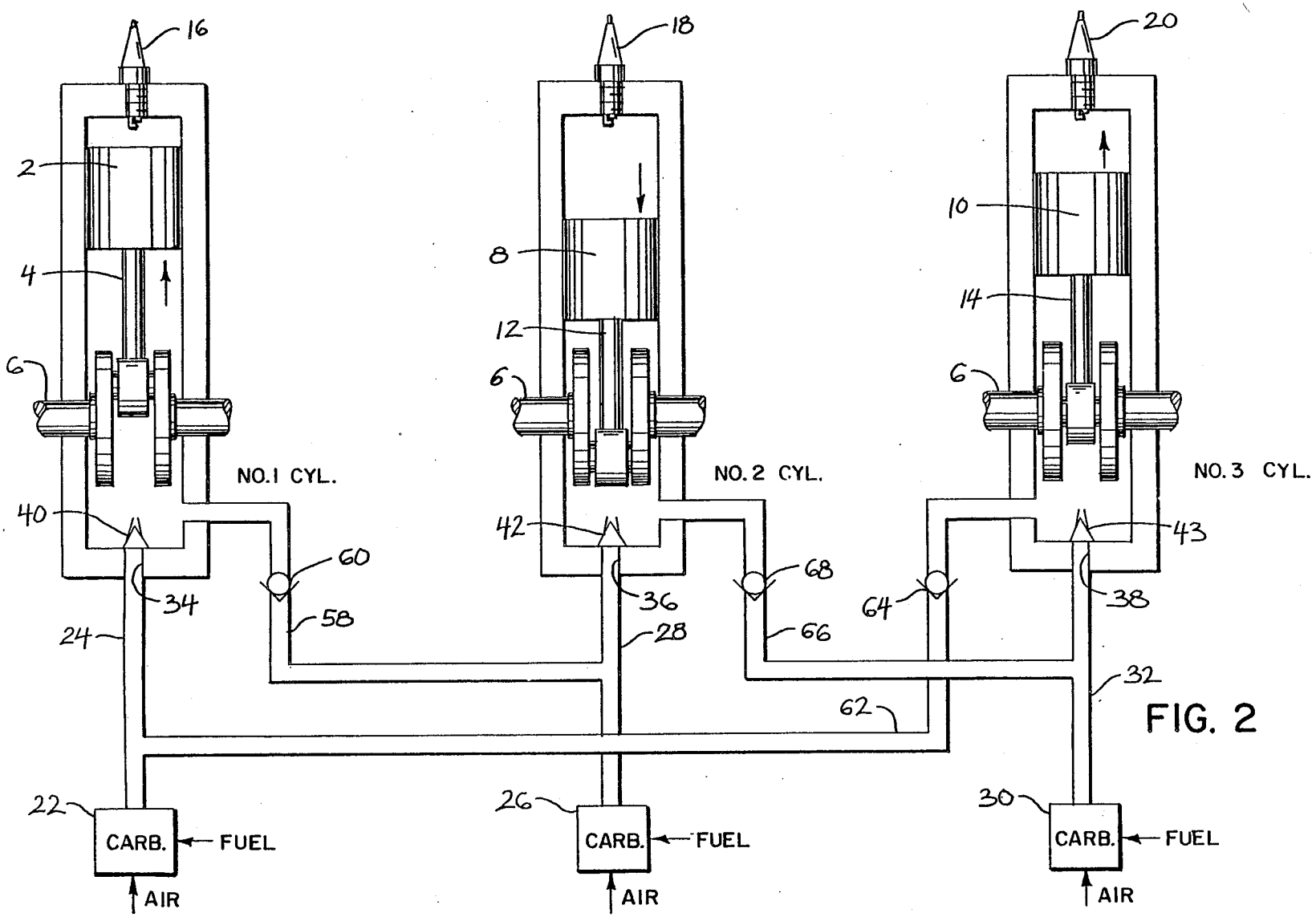
FIG. 2 illustrates an alternate embodiment of a vacuum pulse interconnecting system according to the invention.

In an alternate embodiment as shown in FIG. 2, the crankcase compartment of each cylinder is interconnected with the air-fuel supply means of another cylinder via a passage having an inlet directly into the cylinder crankcase compartment, rather than into the manifold associated with each cylinder. As shown, a passage 58 interconnects the crankcase compartment of the number 1 cylinder with manifold 28 associated with the number 2 cylinder. A check valve 60 is disposed within passage 58. With this arrangement, when a vacuum pulse is created in the crankcase compartment of the number 1 cylinder during the compression stroke of piston 2, such pulse simultaneously draws air-fuel mixture through reed valve 40 and through passage 58 and check valve 60. Carburetor 26 is thereby subjected as above described. The crankcase compartment of the number 3 cylinder is interconnected with manifold 24 by a passage 62 provided with a check valve 64, to subject carburetor 22 to the vacuum pulse created within the crankcase compartment of the number 3 cylinder. Similarly, the crankcase compartment of the number 2 cylinder is interconnected with manifold 32 by a passage 66 provided with a check valve 68, to subject carburetor 30 to the vacuum pulse generated within the crankcase compartment of the number 2 cylinder.

The invention provides a highly satisfactory arrangement for vacuum pulse balancing of a three cylinder two-stroke engine as described. It is to be appreciated, however, that the invention is not limited to application to such a system, and may be advantageously employed with other firing orders and in other multicylinder arrangements. Further, while carburetors have been shown as the air-fuel mixture supply means, it is to be appreciated that any other satisfactory means of supplying an air-fuel mixture may be employed.

Various alternatives and modifications are contemplated as being with the scope of the following claims particularly pointing out and distinctly claiming the subject matter regarded as the invention.

We claim:

1. A two-stroke cycle internal combustion engine, comprising:

a plurality of cylinders;

a reciprocable piston slidably mounted in each said cylinder, said piston creating a vacuum pulse during a portion of its reciprocation;

separate air-fuel mixture supply means associated with each said cylinder, said air-fuel mixture being drawn into said cylinder when said vacuum pulse is created by movement of said piston therein;

means communicating air-fuel mixture from each said separate air-fuel mixture supply means to the cylinder associated therewith; and vacuum pulse balancing means, comprising:

a plurality of passages disposed downstream of each said separate air-fuel mixture supply means and placing each said cylinder in fluid communication with the air-fuel mixture supply means associated with one of the other cylinders; and one-way valve means provided in each said passage for providing transfer of the vacuum pulses from said cylinders through said plurality of passages, so that the vacuum pulse from a first one of said cylinders is transferred to the air-fuel supply means associated with a second one of said cylinders so as to draw air-fuel mixture therefrom when a vacuum pulse is not being supplied by said first one of said cylinders.

2. The engine according to claim 1, further comprising one-way valve means interposed between each said cylinder and its associated air-fuel mixture supply means for providing one-way flow of air-fuel mixture into said cylinder in response to the vacuum pulse created within said cylinder.

3. The engine according to claim 2, wherein said one-way valve means interposed between each said cylinder and its associated air-fuel mixture supply means comprises a reed valve disposed between each said cylinder and its associated means communicating air-fuel mixture thereto.

4. The engine according to claim 2, wherein said separate air-fuel mixture supply means associated with each said cylinder comprises a plurality of carburetors, each said carburetor supplying air-fuel mixture to one of said cylinders through an intake port provided in said cylinder.

5. The engine according to claim 4, wherein said means communicating air-fuel mixture from each carburetor to the cylinder associated therewith comprises an intake manifold disposed between each of said carburetors and the inlet port of each said cylinder.

6. The engine according to claim 5, wherein said plurality of passages are interconnected with said intake manifolds to place each said carburetor in fluid communication with one of the cylinders other than the cylinder with which said carburetor is associated.

7. The engine according to claim 2, wherein said engine comprises three cylinders (numbers 1, 2 and 3) firing in a 1-3-2 order, with a first one of said passages interconnecting the number 1 cylinder with the number 3 cylinder air-fuel mixture supply means and a check valve disposed within said first passage for communicating the vacuum pulse from the number 1 cylinder to the number 3 cylinder air-fuel mixture supply means; a second one of said passages interconnecting the number 2 cylinder with the number 1 cylinder air-fuel mixture supply means and a check valve disposed within said second passage for communicating the vacuum pulse from the number 2 cylinder to the number 1 cylinder air-fuel mixture supply means; and a third passage interconnecting the number 3 cylinder with the number 2 cylinder air-fuel supply means and a check valve disposed within said third passage for communicating a vacuum pulse from said number 3 cylinder to the number 2 cylinder air-fuel mixture supply means.

8. The engine according to claim 2, wherein each said passage has an inlet in direct communication with the interior of one of said cylinders upstream of the one-way valve means interposed between the cylinder and its associated air-fuel mixture supply means.

9. For a two-stroke cycle internal combustion engine including a plurality of cylinders; a reciprocable piston slidably mounted in each said cylinder, said piston creating a vacuum pulse during a portion of its reciprocation; separate air-fuel mixture supply means associated with each said cylinder, said air-fuel mixture being drawn into said cylinder when said vacuum pulse is created by movement of said piston therein; and means communicating air-fuel mixture from each said separate air-fuel mixture supply means to the cylinder associated therewith, a vacuum pulse balancing system, comprising:

a plurality of passages disposed downstream of each said separate air-fuel mixture supply means and placing each said cylinder in fluid communication with one of said cylinders other than the cylinder with which said air-fuel mixture supply means is associated; and one-way valve means provided in each said passage for providing transfer of the vacuum pulses from said cylinders through said plurality of passages, so that the vacuum pulse from one of said cylinders is transferred to the air-fuel mixture supply means associated with another of said cylinders so as to draw air-fuel mixture therefrom when a vacuum pulse is not being supplied by said first-mentioned cylinder.

* * * * *